US005346635A

United States Patent [19]

Khorramian

[11] Patent Number: 5,346,635

[45] Date of Patent: Sep. 13, 1994

[54] LOW AND LIGHT ASH OILS

[75] Inventor: Behrooz A. Khorramian, New York, N.Y.

[73] Assignee: Material Innovation, Inc., Leonia, N.J.

[21] Appl. No.: 70,854

[22] Filed: Jun. 3, 1993

[51] Int. Cl.[5] ..... C10M 141/08; C10M 141/10

[52] U.S. Cl. ..... 252/33.3; 252/50; 252/56 S; 252/49.6; 252/47; 252/47.5; 252/51.5 A

[58] Field of Search ..... 252/33.4, 51.5 A, 33.3, 252/50

[56] References Cited

U.S. PATENT DOCUMENTS

| | | | |
|---|---|---|---|
| 3,876,550 | 4/1975 | Holubec | 252/47.5 |
| 3,923,669 | 12/1975 | Newingham et al. . | |
| 4,125,479 | 11/1978 | Chesluk et al. . | |
| 4,612,129 | 9/1986 | DiBiase et al. . | |
| 4,623,473 | 11/1986 | Davis et al. . | |
| 4,758,362 | 7/1988 | Butke . | |
| 4,917,809 | 4/1990 | Zinke et al. | 252/32.7 E |
| 5,137,980 | 8/1992 | DeGonia et al. | 525/327.6 |

FOREIGN PATENT DOCUMENTS 1569730 6/1980 United Kingdom .

OTHER PUBLICATIONS

"Review of Antiwear Additives For Crankcase Oils", Khorramian, et al., Stevens Inst. of Technology, Hoboken, N.J., 1993, pp. 87–95.

*Primary Examiner*—Jacqueline V. Howard

[57] ABSTRACT

Phosphorus-free, low ash and light ash motor oils containing no metal DTP's, halogens or hazardous substances are disclosed. The phosphorus-free, low ash formulations may be prepared either as a lubricating oil or as a concentrated additive for a lubricating oil. Additionally, light ash motor oils containing no metal DTP, halogens or hazardous substances are disclosed. The light ash formulations may be prepared either as a lubricating oil or as a concentrated additive for a lubricating oil. The use of both the oils and the concentrated additives results in superior price and performance qualities compared to the leading commercial brands.

14 Claims, No Drawings

LOW AND LIGHT ASH OILS

The present invention relates to improved low and light ash lubricating oils. These lubricating oils are an improvement over a standard lubricant formulation that is predominantly a paraffinic base oil. The improved oils contain a diethanolamine derivative ashless friction reducer in addition to other specified additives. The ingredients can be formulated either as a lubricating oil or as concentrated additive for lubricating oils. These new oils and additives show superior quality and performance with remarkable environmental safety characteristics. Both low and light ash lubricating oils contain very small quantity of metals in their formulations. The light ash, in addition, does not contain any heavy elements higher than atomic mass of 40 Daltons.

BACKGROUND OF THE INVENTION

Lubricants and lubricant concentrates perform a variety of functions in automotive applications. One of the most important functions is to reduce friction and wear in moving machinery. Also, lubricants protect metal surfaces against rust and corrosion, act as heat transfer agents, flush out contaminants, absorb shocks, and form seals.

The performance of lubricant oils is a function of the additive composition they contain. The most common types of additives are: antiwear agents, antifoams, emulsifiers, extreme pressure (EP) agents, antioxidants, ashless dispersants, viscosity-index improvers, rust inhibitors, corrosion inhibitors, friction modifiers, and pour point depressants.

Lubricant additives deposit lubricating films on the surface of moving parts which reduces friction. One of the indictions of the friction reducing properties of a lubricating oil is the coefficient of friction. The lower the coefficient of friction, the less the wear. The viscosity-temperature index i.e., the index that characterizes the relationship between oil viscosity and temperature, and the pressure-viscosity index are also important in friction reduction. In addition, factors such as material combinations and their mixability in each other, their solubility in base oils, atomic size of metals in lubricants, valency, molecular structure of materials, electrochemical activity and the type of intermolecular forces between molecules are also important in reducing the coefficient of friction.

Among factors which contribute to the effectiveness of a lubricant oil are high temperature, high loads, and EP or film strength. EP refers to the action of the lubricant against metal-to-metal contact. With an effective EP or film strength, metal scoring and welding can be prevented. Generally, EP property is needed where high torque and rubbing speeds exist.

Certain lubricating oil compositions are known in the art. For instance, U.S. Pat. No. 4,612,129, incorporated herein in its entirety by reference, discloses lubricating oil compositions containing at least one metal salt of at least one dithiocarbamic acid of the formula $R_1(R_2)N$-CSSH.

U.S. Pat. No. 4,917,809, incorporated herein in its entirety by reference, discloses a lubricating composition containing benzotriazoles and olefin copolymers.

U.S. Pat. No. 3,876,550, incorporated herein in its entirety by reference, discloses lubricant compositions containing borated hydrocarbon-substituted succinic acid compounds and hindered phenolics.

A problem with prior lubricant compositions is that they often contained hazardous materials such as zinc dialkyldithiophosphate (ZDTP), phosphorous and halogens. In view of the increasing strictness of environmental regulations, as well as the increased awareness of environmental issues, there has developed a need to produce lubricating oils and concentrated additives for lubricating oils that are in compliance with human and environmental safety standards, while at the same time, facilitate optimum engine performance and protection.

The present invention meets this need by providing improved lubricating oils and concentrated additives for lubricating oils having competitive manufacturing cost efficiency and that already meet or exceed new European environmental standards established for implementation in 1997. The oils and concentrated additives of the present invention contain ingredients that have never before been used in engine lubricants.

SUMMARY OF THE INVENTION

It is an object of the invention to provide a low ash lubricating oil that does not contain metal $DTP_S$, phosphorous, halogens or other hazardous substances.

A further object of the invention is to provide a low ash lubricating oil that does not contain metal DTPs, halogens or hazardous substances.

A still further object of the invention is to provide a light ash lubricating oil that does not contain heavy metals, metal DTPs, halogens or hazardous substances.

A still further object of the invention is to provide a light ash lubricating oil that does not contain heavy metals, metal DTPs, phosphorous, halogens or hazardous substances.

Yet a further object of the invention is to provide a low ash concentrate additive (oil booster) for a lubricating oil that does not contain metal DTPs, phosphorous, halogens or hazardous substances.

A still further object of the invention is to provide a low ash concentrate additive (oil booster) that does not contain metal DTPs, halogens or hazardous substances.

Yet another object of the invention is to provide a light ash concentrate additive (oil booster) for a lubricating oil that does not contain heavy metals, metal DTPs, halogens or hazardous substances.

A still further object of the invention is to provide a light ash concentrate additive (oil booster) that does not contain heavy metals, metal DTPs, phosphorous, halogens or hazardous substances.

Additional objects and advantages of the invention will be set forth in part in the discussion that follows, and in part will be obvious from the description, or may be learned by the practice of the invention. The objects and advantages of the invention will be attained by means of the instrumentalities and combinations particularly pointed out in the appended claims.

To achieve the objects and in accordance with the purpose of the invention, as embodied and broadly described herein, the present invention provides for improved lubricating oil formulations or concentrated additives for lubricating oils that are based on a standard lubricant formulation such as predominantly a paraffinic-based oil. The following ingredients are then added to the base oil: a sulfonate detergent; a silicone antifoam agent, a copper passivator; a copper corrosion inhibitor; a rust inhibitor, a viscosity index improver; a dispersant; a pour point depressant; and a hindered phenolic antioxidant.

A first formulation of the invention is a phosphorous-free, low ash formulation that contains the following ingredients added to the base formula described above: a diethanolamine derivative ashless friction reducer; a molybdenum dialkylcarbamate friction reducer; a zinc diamyldithiocarbamate oxidation inhibitor; and an antimony dialkyldithiocarbamate extreme pressure/antiwear additive. The first formulation may be prepared as either a lubricating oil or as a concentrated additive for lubricating oils.

A second formulation of the invention is a light-ash formulation that contains the following ingredients added to the base formula described above: a diethanolanine derivative ashless friction reducer; a methylene bis(dibutyldithiocarbamate) antioxidant/extreme pressure additive; a bicyclo[3.1.1]hept-2-ene-2,6,6-trimethyl-phosphosulfurized antiwear/antioxidant additive; and a 3-[[bis(1-methylethoxy) phosphionothioyl]thio] propanoic acid ethyl ester antiwear/extreme pressure additive. Optionally, a molybdenum dialkylcarbamate friction reducer may also be added. Again, the light ash formulation may be prepared as either a lubricating oil or as a concentrated additive (oil booster) for lubricating oil.

Both the low and light ash formulations of the present invention are prepared by adding ingredients to a base oil. The base oil is composed of a solvent neutral oil that is poured into a container where it is stirred and heated. The other chemical ingredients are then added to the base oil. Preferably, the detergent is added first and are completely mixed before the remaining chemicals are added. It is also preferred that the dispersant and viscosity improver are added last. After all the chemicals are added, the complete mixture is continually heated and constantly stirred for a sufficient amount of time to insure complete mixing.

All the formulations were tested and their performance properties were determined to be superior to conventional lubricating oils, including those that contain phosphates or have higher ash levels.

The lubricating oil formulations may be used as is. The concentrated additive formulations can be used as oil boosters in an amount such as 10% to improve existing motor oils or they can be sold as an aftermarket treatment package.

DETAILED DESCRIPTION OF THE INVENTION

Reference will now be made in detail to the presently preferred embodiments of the invention, which, together with the following examples, serve to explain the principles of the invention.

The present invention first provides a formulation that is a phosphorus-free, low ash or light ash formulation. This phosphorus-free formulation can be prepared either as a low ash or light ash lubricating oil or as a concentrated additive for lubricating oils.

When the phosphorus-free, low ash or light ash formulation is prepared as a lubricating oil, it is prepared by adding certain additional additives to a base formula. The base oil can be a natural oil or a synthetic lubricating oil. Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthethic lubricating oils include hydrocarbon oils and halosubstituted hydrocarbon oils such as polymerized and interpolymerized olefins (e.g., polybutylenes, polypropylenes, propyleneisobutylene, copolymers, chlorinated polybutylenes, etc.); poly(1-hexenes), poly(1-octenes), poly(1-decenes) and mixtures thereof; alkylbenzenes (e.g., dodecylbenzenes, tetradecylbenzenes dinonylbenzenes di-(2-ethylhexylbenzenes); polyphenyls (e.g., biphenyls, terphenyls, alkylated polyphenyls); alkylated diphenyl ethers and alkylated diphenyl sulfides and the derivatives, analogs and homologs thereof and the like.

The preferred base formula is a lubricant formulation that is predominately a paraffinic base oil (CAS #64741-88-4) that accounts for approximately 80% of the total concentration of the phosphorus-free lubricating low ash oil formulation. The additional ingredients are then added to the paraffinic base oil.

The first additive to the paraffinic base oil is a detergent. Detergents help control varnish, ring zone deposits and rust by keeping insoluble particles in colloidal suspension and in some case by neutralizing acids. Metallic detergents accelerate the oxidation of oil by keeping the metal surfaces clean and thus permitting the metals to act as catalysts for oil oxidation and exposing themselves to corrosion by acid and moisture. In a preferred embodiment of this invention, a sulfonate detergent is selected for addition to the paraffinic base oil. Preferably, the sulfonate detergent is a magnesium or calcium salt, or both, of alkylated aryl sulfonic acids and is present in the final phosphorus-free, low ash or light ash formulation in an amount from about 1 to about 3%.

The paraffinic base oil also contains a silicone antifoam additive. In a preferred embodiment of this invention, the silicone antifoam agent is a compounded silicone fluid that is present in the final phosphorus-free, low ash or light ash lubricating oil in an amount of about 0.005%.

The paraffinic base oil also contains a copper passivator. Preferably the copper passivator is a benzotriazole derivative such as 1H-benzotriazole-1-Methanamine,N,N-bis(2-ethyl hexyl)methyl. The copper passivator is preferably present in the final phosphorus-free, low ash or light ash lubricating oil in an amount from about 0.05 to about 1%.

The paraffinic base oil also contains an inhibitor. Inhibitors are generally agents that prevent or minimize corrosion, wear, oxidation, friction, rust and foaming. Preferably, the paraffinic base oil contains a copper corrosion inhibitor that is preferably a dimercapto thiadiazole derivative. The copper corrosion inhibitor is present in the final phosphorus-free, low ash or light ash lubricating oil in approximately 0.05 to about 1.5%.

The paraffinic base oil also contains a rust inhibitor. One such inhibitor is (tetrapropenyl)-butanedioic acid, monoester with 1,2-propanediol and (tetrapropenyl)-butanedioic acid. The rust inhibitor is preferably present in the final phosphorous-free, low ash or light ash lubricating oil in an amount from about 0.05 to about 1%.

The paraffinic base oil also contains a viscosity index improver. Viscosity index improvers reduce the tendency of an oil to change viscosity with temperature. They are generally high molecular weight polymers or copolymers. Some viscosity improvers may function as pour point depressants and also as dispersants. The viscosity index improvers are generally selected from polyisobutylene, olefin copolymers, styrene ester and polymethacrylates. Preferably, the viscosity index improver is an ethylene-propylene copolymer and is present in the final phosphorus-free, low ash or light ash lubricating oil in an amount from about 9 to about 10%.

The paraffinic base oil also contains a borated or nonborated dispersant. Dispersants are ashless cleaning agents that prevent the formation of sediment in the crank case at low temperatures and during low load operation. Among these dispersants are succinamides, succinate esters, Mannich types and alkyphenolamines. Preferably, the dispersant is a nitrogen functionalized borated polyisobutenyl succinic anhydride. The borated or nonborated dispersent is preferably present in the final phosphorus-free, low ash or light ash formulation in an amount of about 2%.

The paraffinic base oil also contains a pour point depressant. Pour point depressants are low molecular weight polymers which lower the freezing point of oils, thus allowing the oils to flow at low temperatures. Examples of pour point depressants are polymethacryates, alkylated wax naphthalene, styrene-maleic ester copolymers, alkylated wax phenols, and vinyl ester-vinyl ether copolymers. Preferably, the pour point depressant used in the present invention is a dialkyl fumerate/vinyl acetate copolymer and is present in the final phosphorus-free, low ash or light ash lubricating oil in an amount of about 0.3%.

Finally, the paraffinic base oil may optionally contain antioxidants. Preferably, the antioxidant is a hindered phenolic antioxidant such as a 3,5-di-tert-butyl-4-hydroxylhydrocinnamic acid alkyl ester. The hindered phenolic antioxidant is present in the final phosphorus-free, low ash or light ash lubricating oil in an amount from about 0.5% to about 5%.

There are three preferred embodiments of the phosphorus-free, low ash or light ash lubricating oils made from the paraffinic base oil and additives discussed above. Each of the three embodiments first additionally contains an ashless friction reducer. Preferably, the ashless friction reducer is a diethanolamine derivative and is present in an amount of about 0.5%. In addition, the first embodiment of the phosphorus-free, low ash lubricating oil contains the hindered phenolic antioxidant described above in an amount of about 1.0% of the final formulation. Further, the preferred first embodiment contains a friction reducer, preferably an organo molybdenum complex such as molybdenum dialkylcarbamate present in an amount of approximately 0.5% of the final formulation.

The preferred first embodiment also contains a oxidation inhibitor, preferably a zinc diamyldithiocarbamate oxidation inhibitor, that is present in an amount of approximately 1% of the final formulation. Further, the first embodiment contains an extreme pressure/antiwear additive, preferably, an antimony dialkyldithiocarbamate compound that is present in an amount of approximately 1.0% of the final formulation.

The second preferred embodiment of the phosphorus-free, light ash lubricating oil contains the paraffinic base oil and additives described above but does not contain oxidation inhibitor (zinc diamyldithiocarbamate), antimony dialkyldithiocarbamate, and organo molybdenum complex. Instead, the preferred second embodiment contains the following ingredients added to the paraffinic base oil: 0.5% hindered phenolic antioxidant, an antioxidant/extreme pressure additive, such as a methylene-bis(dibutyldithiocarbamate) present in the final formulation in an amount of approximately 1.0%; and an antiwear/antioxidant ingredient, such as a dithiocarbamate derivative, that is present in the final formulation in an amount of approximately 1.5%.

The preferred third embodiment of the phosphorus-free, low ash lubricating oil contains the same formulation as the preferred second embodiment except that the third embodiment contains an additional friction reducer, preferably an organo molybdenum complex, such as, molybdenum dialkylcarbamate. This additional friction reducer is present in the final formulation in an amount of about 0.5%.

The above-mentioned three embodiments can also be formulated as concentrated additives for lubricating oils. Thus, the present invention is also directed to the formulation of phosphorous-free, low ash or light ash concentrated additives for lubricating oils. There are three preferred embodiments of the invention directed to phosphorous-free, low ash or light ash concentrated additives for lubricating oils.

The first preferred embodiment of the phosphorus-free, low ash concentrated additives for lubricating oil is identical to the first embodiment described for the phosphorous-free, low ash lubricating oil except that the amounts of the ingredients differ. More specifically, the first preferred phosphorus-free, low ash concentrated additive contains approximately 50% of the base oil; from about 1% to about 3% of the sulfonate detergent; about 0.005% of the silicone antifoam additive; about 0.5% of the copper passivator; about 1.0% of the copper corrosion inhibitor; about 0.5% of rust inhibitor; about 3.0% of the ashless friction reducer compound; about 9 to about 10% of the viscosity improver index compound; about 2% of the dispersant; about 0.3% of the pour point depressant; about 5.0% of phenolic antioxidant; about 5.0% of the friction reducer; about 10% of the zinc oxidation inhibitor; and about 7% of the antimony extreme pressure/antiwear compound.

A second preferred embodiment of the phosphorous-free, light ash concentrated additives contains the same ingredients as the second preferred embodiment of the phosphorous-free, light ash lubricating oil except that the amounts contained in the concentrated additive differ from the amount in the lubricating oils. Specifically, the second preferred embodiment of the phosphorus-free, low ash concentrated additives contain the following: 50% of the base oil; about 1 to about 3% of the sulfonate detergent; about 0.005% of the silicone antifoam additive; about 0.5% of the copper passivator; 1.0% of the copper corrosion inhibitor; about 0.5 of the rust inhibitor; about 3.0% of the ashless friction reducer; about 9 to about 10% of the viscosity index improver; about 2% of the dispersant; about 0.3% of the pour point depressant; about 5.0% of the antioxidant-/extreme pressure additive; and about 10% of the antiwear/antioxidant additive. The second preferred concentrate embodiment also contains 5.0% phenolic antioxidant.

The preferred third embodiment of the phosphorous-free, low ash concentrated additive contains all of the elements in the same amount described for the second embodiment of the light ash concentrated additive, plus an additional compound. The additional compound found in the preferred third embodiment is about 5.0% of the organo molybdenum complex friction reducer. Like the second preferred concentrate, the preferred third embodiment contains 5.0% phenoic antioxidant.

The invention is further directed to light ash lubricating oils and light ash concentrated additives for lubricating oils. The light ash lubricating oils are prepared by adding certain additives to a base formula. Preferably, the base formula for the light ash lubricating oils is the same as the base formula described for the phosphorus-free, low ash lubricating oils. That is, the base formula is a standard lubricant formulation that a predominantly a paraffinic based oil which accounts for approximately 80% of the total concentration of the light ash lubricating oil. The ingredients added to the paraffinic base oil for the light ash lubricating oils are the same and are in the same amount as those described for the low ash lubricating oils. However, the light ash lubricating oils do not contain heavy metals or elements with atomic mass greater than 40 Daltons.

More specifically, both embodiments of the light ash lubricating oil formulations contains the following ingredients: about 1% to about 3% of the sulfonate detergent described above; about 0.005% of the silicone antifoam additive described above; about 0.05% of the copper passivator described above; about 0.1% of the copper corrosion inhibitor described above; about 0.05% rust inhibitor described above, about 0.5% of the ashless friction reducer described above; about 9 to about 10% of the viscosity index improver described above; about 2% of the dispersant described above; and about 0.3% of the pour point depressant described above. Additionally, both preferred embodiments of the light ash lubricating oil formulation contain the antioxidant described above, i.e., the hindered phenolic antioxidant, in approximately 1.0% of the final formulation.

The first preferred embodiment of the light ash lubricating oil formulation contains, in addition to the base oil and ingredients described above, the following ingredients: about 1% of an antioxidant/extreme pressure additive, preferably a methylene bis-(dibutyldithiocarbamate); about 1% of an antiwear/antioxidant additive, preferable a bicyclo[3.1.1]hept2-ene-2,6,6-trimethyl-phosphosulfurized compound; and about 1% of an antiwear/extreme pressure additive; such as a 3-[[bis(1-methylethoxy) phosphinothioyl]thio] propanoic acid ethyl ester.

The preferred second embodiment of the light ash, phosphorous-free lubricating oil formulation is similar to the first embodiment of the light ash lubricating oil formulation except that it does not contain any antiwear/antioxidant additive of bicyclo trimethyl-phosphosulfurized compound and antiwear/extreme pressure additive of phosphinothioyl thio propionic acid ethyl ester. Instead, the light ash phosphorous-free lubricating oil contains about 1.5% of the antiwear/antioxidant compound of dithiocarbamate derivative. All of the remaining ingredients of the preferred first embodiment of the light ash lubricating oil formulation are present in about the same amount in the preferred second embodiment of the light ash lubricating oil formulation.

The light ash formulation may also be prepared as a concentrated additive for lubricating oils. There are two preferred embodiments of a light ash concentrated additive for lubricating oils, and they contain the same ingredients as the two preferred embodiments of the light ash lubricating oils except in different amounts. Specifically, the light ash concentrated additives contain the ingredients discussed above in the following amounts: approximately 50% of the paraffinic based oil; about 1 to about 3% of the sulfonate detergent discussed above; about 0.005% of the silicone antifoam additive discussed above; about 0.5% of the copper passivator discussed above; about 1.0% of the copper corrosion inhibitor discussed above; about 0.5% of the rust inhibitor discussed above; about 3% of the ashless friction reducer discussed above; about 9 to about 10% of the viscosity index improver discussed above; about 2% of the dispersant discussed above; about 0.3% of the pour point depressant discussed above; about 5% of the antioxidant, such as the hindered phenolic antioxidant, about 5% of the antioxidant/extreme pressure additive, such as the methylene bis-(dibutyldithiocarbamate) compound discussed above; about 5% of the antiwear-/antioxidant compound, such as the bicyclo trimethyl phosphosulfurized compound discussed above; and about 5.0% of the antiwear/extreme pressure phosphorous containing compound discussed above.

The second preferred embodiment of the light ash, phosphorous-free concentrated additives contains all of the ingredients in the same amounts as the first preferred embodiment of the light ash concentrated additive except that it does not contain antiwear/antioxidant additive or bicyclotrimethyl-phosphosulfurized compound and antiwear/extreme pressure additive of phosphinothioyl thio propionic acid ethyl ester. Instead, the light ash phosphorous-free concentrated additive contains about 10% of the antiwear/antioxidant compound of dithiocarbonate derivative.

The lubricating oils and concentrated additives of the present invention are preferably prepared by the following procedure. The paraffinic base oil is stirred and heated to a temperature within the range of about room temperature, i.e., approximately 24° C., to about 60° C. The ingredients are then added to the base oil. Preferably, the detergent is added first and completely mixed before any other ingredients are added. The borated dispersants and the viscosity index improver are the last chemicals to be added. Once all the chemicals have been added, the mixture is continually heated to a temperature below 60° C. and constantly stirred for a sufficient time to insure complete mixing.

All of the lubricating oil formulations described above may be used as is. The lubricating oil formulations described herein show superior performance in categories such as reducing engine friction and wear, rust and corrosion protection, oil oxidation, and in deposit formation.

The concentrated additives described above may be used to improve existing motor oils or they may be sold as an aftermarket treatment package. Concentrated additives are added to already available commercial oils in an amount as little as 10% by volume. When the concentrated additives are used in commercial oils in an amount of about 10% by volume, not only their performance is improved, but the manufacturing costs of producing the oil is decreased.

It is to be understood that the application of the teachings of the present invention to a specific problem will be within the capabilities of one having ordinary skill in the art in light of the teachings contained herein. Examples of the products of the present invention and processes of their preparation and for their use appear in the following examples.

Experimental Procedures

For each of the examples appearing below, the light or low ash lubricating oil or concentrated additive was prepared by the following procedure: a base oil composed of 80% solvent neutral (SN-150 from SUNOCO) and 20% solvent neutral (SN-100 from SUNOCO) was poured in a container equipped with a mechanical stiring machine and a controlled heating system. The temperature of the oil ranged from room temperature, that is approximately 24° C., to 60° C. While the base oil was under heating and constant stirring, specific quantities of other chemicals were added to the base oil. For optimization of the base oil, detergent was added first and after the detergent was completely mixed, the other chemicals were added. In addition, the dispersant and viscosity improver were added last. Following the addition of all of the chemicals, the complete mixture was continually heated to a temperature below 60° C. and constantly stirred for two hours to insure complete mixing of all of the chemicals into the base oil.

The ingredients listed in Table 1 are those contained in each of the following examples. Thus, when an example refers to a compound followed by a number, the referred-to compound is the one which corresponds to the number listed in Table 1.

Certain standard tests were employed for assessing the lubricant oil properties. Such tests are as follows:

| TEST | | PURPOSE |
|---|---|---|
| ASTM D-130[1] | | COPPER CORROSION |
| ASTM D-4172[2] | 4-BALL | SCAR DIAMETER |
| ASTM D-3233B[3] | FALEX STEP TEST | FRICTION COEFFICIENT |
| ASTM D-482[4] | | ASH CONTENT |
| ASTM D-92[5] | | FLASH POINT |
| ASTM D-874[6] | | SULFATED ASH |
| ASTM D-2896[2] | | TOTAL BASE NO. |
| ASTM D-664-87[7] | | TOTAL BASE NO. |
| ASTM D-4742-88[8] | | THIN-FILM OXYGEN UPTAKE (TFOUT) |
| (CMOT) | | CATERPILLAR MICRO-OXIDATION TEST |

[1]From American Society for Testing and Material Annual Book published December 1988.
[2]From American Society for Testing and Material Annual Book published January 1989.
[3]From American Society for Testing and Material Annual Book published December 1986.
[4]From American Society for Testing and Material Annual Book published June 1991.
[5]From American Society for Testing and Material Annual Book published December 1990.
[6]From American Society for Testing and Material Annual Book published June 1989.
[7]From American Society for Testing and Material Annual Book published January 1990.
[8]From American Society for Testing and Materials Annual Book published April 1988.

TABLE 1

| Code | Chemical | Chemical Name and Source |
|---|---|---|
| 1 | Base Oil or Solvent Neutral | Petroleum Hydrocarbon Oil (Paraffinic Oil) (SN-100 & SN-150) SUNOCO |
| 2A-1 | Sulfonate Detergent | Magnesium Salt of Alkylated Aryla Sulfonic Acid (ECA 11190-Exxon Chemical Americas) (HiTec 654 - Ethyl Corporation) |
| 2A-2 | Sulfonate Detergent | Calcium Salt of Benzene Sulfonic Acid (HiTec 611-Ethyl Corporation) |
| 3B | Silicone Antifoam | Compounded Silicone Fluid (Antifoam 1400 - Dow Corning) |
| 4C | Copper Passivator | Triazole Derivative IH-Benzotriazole-1-Methanamine,N,N, Bis(2-Ethyl Hexyl) - Methyl (Reomet 39 CIBA GEIGY) |
| 5D | Copper Corrosion Inhibitor | 2,5-Dimercapto-1,3,4-Thiadiazole Derivative (Cuvan 826 - R.T. Vanderbuilt Company, Inc.) |
| 6E | Ashless Friction Reducer | Diethanolamine Derivative (OD-896 - RT Vanderbilt Company, Inc.) |
| 7F | VI Improver (Viscosity Index Improver) | Copolymer of Ethylene Propyeane (TLA-347A) - TEXACO |
| 8G-1 | Borated Dispersant | Borated Polyisobutenyl Succinic Anhydride Nitrogen Functionalized Dispersant Paranox ECA 12819 (Exxon Chemical Americas) |
| 8G-2 | Dispersant | Amines, polyethylene poly-, compounds with (polybutenyl) succinic anhydride |
| 9H | Pour Point Depresant | Dialykl Fumerate/Vinyl Acetate Copolymer Paraflow 385 (Exxon Chemical Americas) |
| 10I | Antioxidant | 3,5 di-tert-butyl-4 Hyroxyl Hydrocinnamic acid, Alkyl Esters Irganox L135 - CIBA - GEIGY |
| 11J | Friction Reducer | Organo Molybdenum Complex (Molybdenum Dialkylcarbamate) OD-855 (R.T. Vanderbilt Company, Inc.) |
| 12K | Oxidation Inhibitor | Zinc Diamyldithiocarbamate Vanlub AZ (R.T. Vanderbilt Company, Inc.) |
| 13L | Extreme Pressure/ Antiwear | Antimony Dialkyldithiocarbamate Vanlub 73 (R.T. Vanderbilt Company, Inc.) |
| 14M | Atioxidant/ Extreme Pressure | Methylene Bis (Dibutyldithiocarbamate) Vanlub 7723 (R.T. Vanderbilt Company, Inc.) |
| 15N | Antiwear/ Antioxidant | Bicyclo [3.1.1] Hept-2-Ene 2,6,6 Trimethyl Phosphosulfurized HiTec 649 (Ethyl Corporation) |
| 16O | Antiwear/ Extreme Pressure | 3-{{bis(1-methylethoxy) phosphinothioyl }thio}Propanic Acid, Ethyl Ester Irgalub 63 (CIBA-GEIGY) |
| I7P | Antiwear/ Antioxident | Dithiocarbamate derivative, Vanlub 732 (R.T. Vanderbilt Company, Inc.) |
| 18Q | Rust Inhibitor | (Tetrapropenyl)-Butanedioic Acid, Monoester With 1,2-propanediol and (Tetrapropenyl)-butanedioic acid REOCOR12 (Ciba-Geigy) |

EXAMPLE 1

Low Ash Engine Oil 1 (LAO-1)

LAO-1 was prepared according to the method described herein and contained the following ingredients:

About 80% of the base oil of compound 1; 2% of the sulfonate detergent of compound 2A, 0.005% of the silicone antifoam additive compound 3B, 0.05% of the copper passivator compound of 4C; 0.1% of the copper corrosive inhibitor compound of 5D; 0.05% of the rust inhibitor 18Q, 0.5% of the ashless friction reducer compound of 6E; 9.25% of the viscosity improver compound of 7F; 2% of a dispersant compound of 8G; 0.3% of the pour point depressant the compounds of 9H; 1% of the antioxidant compound of 10I; 0.5% of the friction reducer the compound of 11J, 1.0% of the oxidation inhibitor the compound of 12K; and 1.0% of the extreme pressure/antiwear compound the compound of 13L. The ingredients were mixed as described in the procedure above and LAO-1 was formulated.

LAO-1 was a low ash oil which contained basically no phorporous, had a low sulfur content, and contained an antiwear ingredient as well as a friction reducer. The ash content of the LAO-1 was typically 0.6%, while the phosphorous content was typically 6 ppm (trace). The sulfur content of the oil of Example 1 was typically 0.25%. Upon testing, the scar diameter was typically 0.42 mm and the coefficient of friction was typically 0.079.

EXAMPLE 2

Low Ash Engine Oil 2 (LAO-2)

LAO-2 was prepared according to the method described herein and contained the following elements:

About 80% of the base oil of compound 1; 2% of the sulfonate detergent of compound 2A; 0.005% of the silicone antifoam additive compound 3B; 0.05% of the copper passivator compound of 4C; 0.1% of the copper corrosive inhibitor compound 5D; 0.05% of the rust inhibitor of 18Q, 0.5% of the ashless friction reducer compound 6E; 9.25% of the viscosity improver compound 7F; 2% of a dispersant compound 8G, 0.3% of the pour point depressant compound 9H; 1% of the antioxidant compound of 10I, 0.5% of the friction reducer compound of 11J, 1% of the antioxidant extreme pressure compound 14M; 1% of the antiwear/antioxidant compound 15N; and 1% of an antiwear/extreme pressure compound 160.

LAO-2 typically contained an ash content of 0.60%, wherein the ash contained mainly light elements, magnesium (or calcium) and lighter elements. LAO-2 also contained a friction reducer and upon testing had a coefficient of friction typically 0.077. Further, upon testing, the anti-wear/scar diameter was typically 0.38 mm.

EXAMPLE 3

Light Ash Engine Oil 3 (LAO-3)

LAO-3 was prepared according to the method described above and contained the following ingredients:

About 80% of the base oil compound 1; 2% of the sulfonate detergent of compound 2A; 0.005% of the silicone antifoam additive compound 3B; 0.05% of the copper passivator compound of 4C; 0.1% of the copper corrosive inhibitor compound 5D; 0.05% of the rust inhibitor 18Q; 0.5% of the ashless friction reducer compound of 6E; 9.25% of the viscosity improver compound of 7F; 2% of a dispersant compound 8G; 0.3% of the pour point depressant compound 9H, 1% of the antioxidant compound of 10I; 1.0% of the antioxidant-/extreme pressure compound 14M; 1.0% of the antiwear/antioxidant compound 15N; and 1.0% of an antiwear/extreme pressure compound 160.

LAO-3 had a very light ash content, 0.49%, wherein the ash contained only light elements, for example, magnesium (or calcium) and lighter elements. Upon testing, LAO-3 had a scar diameter of 0.46 mm and the coefficient of friction was typically 0.079.

EXAMPLE 4

Low Ash Engine Oil 6 (LAO-6)

LAO-6 was prepared according to the method described herein and contained the following ingredients:

80% of the base oil compound 1; 2% of the sulfonate detergent compound 2A; 0.005% of the silicone antifoam additive compound 3B, 0.05% of the copper passivator compound 4C; 0.1% of the copper corrosive inhibitor compound 5D; 0.05% of the rust inhibitor compound 18Q; 0.5% of the ashless friction reducer compound 6E; 9.25% of the viscosity improver compound 7F; 2% of a dispersant compound 8G; 0.3% of the pour point depressant compounds 9H; 0.5% of the phenolic antioxidant 10I; 1.0% of the antioxidant/extreme pressure compound 14M and 1.5% of the antiwear/antioxidant compound 17P.

LAO-6 has a very low ash content of typically 0.49%, wherein the ash contains only light elements, for example, magnesium (or calcium) and lighter elements. LAO-6 was phosphorous free and had a coefficient of friction typically 0.08.

EXAMPLE 5

Low Ash Engine Oil 7 (LAO-7)

LAO-7 was made according to the method described above and contained the following components:

80% of the base oil component 1; 2% of the sulfonate detergent compound 2A, 0.005% of the silicone antifoam additive compound 3B; 0.05% of the copper passivator compound 4C; 0.1% of the copper corrosive inhibitor 5D; 0.05% of the rust inhibitor 18Q; 0.5% of the ashless friction reducer compound 6E; 9.25% of the viscosity improver compound 7F; 2% of a dispersant compound 8G; 0.3% of the pour point depressant compounds 9H; 0.5% of the phenolic antioxidant 10I; 0.5% of a friction reducer compound 11J; 1.0% of the antioxidant/extreme pressure compound 14M; and 1.5% of the antiwear/antioxidant compound 17P.

LAO-7 contained a very low ash content typically 0.55%, wherein the ash contained mainly light elements, for example, magnesium (or calcium) and light elements. LAO-7 was phosphorous free, contained an antiwear additive, and upon testing had a coefficient of friction typically 0.08.

EXAMPLE 6

Low Ash Booster Engine Oil 1 (LABO-1)

LABO-1, a concentrated version of LAO-1 was prepared according to the method described above. LABO-1 contained the following components:

50% of the base oil compound 1; 3% of the sulfonate detergent compound 2A; 0.005% of the silicone antifoam agent compound 3B, 0.5% of a copper passivator compound 4C; 1.0% of the copper corrosive inhibitor compound 5D; 0.5% of a rust inhibitor 18Q; 3.0% of the ashless friction reducer compound 6E, 9.25% of a viscosity index improver compound 7F; 2.0% of a dispersant compound 8G; 0.3% of a pour point depressant compound 9H; 5.0% of the antioxidant compound 10I; 5.0% of the friction reducer compound 11J; 10.0% of the oxidation inhibitor compound 12K and 7.0% of the extreme pressure/anti-wear agent compound 13L.

LABO-1 had a low ash content and no phosphorous.

EXAMPLE 7

Light Ash Booster Engine Oil 2 (LABO-2)

LABO-2 is a concentrated version of LAO-3, the oil described in Example 3. LABO-2 was prepared according to the method described herein and contained the following components:

50% of the base oil compound 1; 1-3% of the sulfonate detergent compound 2A; 0.005% of the silicone antifoam compound 3B; 0.5% of a copper passivator compound 4C; 1.0% of a copper corrosion inhibitor compound 5D; 0.5% of a rust inhibitor compound 18Q; 3.0% of the ashless friction reducer compound 6E, 9-10% of a viscosity index improver compound 7F; 2.0% of a dispersant compound 8G, 0.3% of a pour point depressant compound 9H; 5.0% of an antioxidant compound 10I, 5.0% of an antioxidant/extreme pressure compound 14M, 5.0% of an antiwear/antioxidant compound 15N; and 5.0% of an antiwear/extreme pressure compound 160.

LABO-2 had a light ash content, wherein the ash contained light elements, magnesium (or calcium) and lighter elements.

EXAMPLE 8

Low Ash Engine Booster Oil 3 (LABO-3)

LABO-3 is a concentrated version of the LAO-2, the oil described in Example 2. LABO-3 was prepared according to the method described herein and had the following components:

50% of the base oil component 1; 2% of the sulfonate detergent compound 2A; 0.005% of the silicone antifoam compound 3B; 0.5% of the copper passivator compound 4C; 1.0% of the copper corrosive inhibitor compound 5D, 0.5% of a rust inhibitor compound 18Q, 3.0% of the ashless friction reducer compound of 6E; 9.25% of the viscosity improver compound 7F; 2% of a dispersant compound 8G; 0.3% of the pour point depressant compound 9H; 5.0% of the antioxidant compound 10I; 5.0% of the friction reducer compound 11J; 5.0% of an antioxidant extreme pressure compound 14M, 5.0% of the antiwear/antioxidant compound 15N; and 5% of the antiwear/extreme pressure compound 160.

The mechanical and engine properties of LABO-3 were similar to LABO-2.

EXAMPLE 9

Light Ash Engine Booster Oil 4 (LABO-4)

LABO-4 is a concentrated version of LAO-6, the oil described in Example 4. LABO-4 was prepared according to the method described herein and contained the following components:

50% of the base oil compound 1; 1–3% of the sulfonate detergent compound 2A; 0.005% of the silicone antifoam compound 3B; 0.5% of the copper passivator compound 4C; 1.0% of the copper corrosion inhibitor compound 5D; 0.5% of a rust inhibitor compound 18Q, 3.0% of the ashless friction reducer compound 6E; 9–10% of the viscosity index improver compound 7F; 2.0% of a dispersant compound 8G; 0.3% of a pour point depressant compound 9H; 5.0% of the antioxidant compound 10I; 5.0% of an antioxidant/extreme pressure additive compound 14M; and 10% of the antiwear-/antioxidant compound 17P.

LABO-4 had properties similar to those of the oil described in Example 7.

EXAMPLE 10

Low Ash Booster Engine Oil 5 (LABO-5)

LABO-5 is a concentrated version of LAO-7, the oil described in Example 5. LABO-5 was prepared according to the method described above and has the following components:

50% of the base oil compound 1, 1–3% of the sulfonate detergent compound 2A; 0.005% of the silicone antifoam compound 3B; 1.0% of the copper passivator compound 4C; 1.0% of the copper corrosion inhibitor compound 5D; 0.5% of a rust inhibitor compound 18Q; 3.0% of the ashless friction reducer compound 6E; 9–10% of the viscosity index improver compound 7F; 2.0% of a dispersant compound 8G; 0.3% of the pour point depressant compound 9H; 5.0% of the antioxidant compound 10I; 5.0% of a friction reducer additive compound 11J; 5.0% of the antioxidant/extreme pressure compound 14M; and 10% of an antiwear antioxidant additive compound 17P.

EXAMPLE 11

Use Of LABO-1

LABO-1, the oil described above in Example 6, was used in about 10% by volume in a commercial oil (Mobil Super HP MO-SHP). The use of LABO-1 reduced both the wear and friction of the commercial oil and increased the anti-oxidancy of the commercial oil. The results of the use of LABO-1 in MO-SHP are depicted in Table 2.

TABLE 2

| | MO-SHP | 10% LABO-1 + 90% MO-SHP |
|---|---|---|
| Scar Diameter, mm | 0.46 | 0.38 |
| Coefficient of Friction | 0.10 | 0.075 |
| TFOUT, Minutes | 108 | 303 |
| CMOT, Minutes | 123 | 172 |

Similarly, use of LABO-1 reduced the wear and friction, as well as increasing the antioxidancy of another commercial oil Mobil-1 oil. The results of the use of LABO-1 in Mobil-1 are depicted in Table 3.

TABLE 3

| | Mobil-1 | 90% Mobil-1 + 10% LABO-1 |
|---|---|---|
| Scar Diameter, mm | 0.38 | 0.38 |
| Coefficient of Friction | 0.098 | 0.072 |
| TFOUT, Minutes | 269 | 500 |
| CMOT, Minutes | 131 | Greater than 300 |

EXAMPLE 12

Use Of LABO-2

LABO-2, the oil described in Example 7 was used in about 10% by volume in a commercial oil Mobil Super HP (MO-SHP). The use of LABO-2 in MO-SHP reduced the friction and increased the antioxidancy as compared to MO-SHP alone. The results of the use of 10% of LABO-2 with the Mobil Oil-SHP are depicted in Table 4.

TABLE 4

| | MO-SHP | 10% LABO-2 + 90% MO-SHP |
|---|---|---|
| Scar Diameter, mm | 0.46 | 0.46 |
| Coefficient of Friction | 0.10 | 0.083 |
| TFOUT | 108 | 215 |

Similarly, use of LABO-2 with another commercial oil, Mobil-1, likewise decreased the friction and increased the antioxidancy. The results of the use of 10% of LABO-2 with Mobil-1 are depicted in Table 5.

TABLE 5

| | Mobil-1 | 10% LABO-2 + 90% Mobil-1 |
|---|---|---|
| Scar Diameter, mm | 0.38 | 0.38 |
| Coefficient of Friction | 0.098 | 0.083 |
| TFOUT | 169 | 202 |

What is claimed:

1. A lubricating oil comprising:

a. about 80% of a paraffinic base oil;

b. about 1 to about 3% of a magnesium salt of an alkylated aryl sulfonic acid or calcium salt of benzene sulfonic acid;
c. about 0.005% of a compounded silicone fluid;
d. about 0.05 to 1.5% of 1H-Benzotriazole-1-Methanamine N,N-bis(2-Ethyl Hexyl)-Methyl;
e. about 0.05 to about 0.15% of a 2,5-dimercapto-1,3,4-thiadiazole derivative;
h. about 0.50% of a diethanolamine derivative;
i. about 9 to about 10% of an ethylene-propylene copolymer;
j. about 2% of a dispersant selected from the group consisting of a borated polyisobutenyl succinic anhydride, an amine with (polybuteryl) succinic, a polyethylene poly-, compound with (polybutenyl)-succinic anhydride and combinations thereof;
k. about 0.3% of a dialkyl fumerate/vinyl acetate copolymer; and
l. about 0.05% of the group consisting of (tetrapropenyl)-butanedioic acid, monoester with 1,2-propanediol and (Tetrapropenyl))-butanedioic acid wherein said the lubricant oil is absolutely free of ZDTP.

2. The lubricating oil of claim 1 further comprising about 0.5% 3,5 di-tert-butyl-4-hydroxylhydrocinnamic acid, alkyl esters; about 1.0% of methylene bis(dibutyldithiocarbamate) and about 1.5% of a dithiocarbamate derivative.

3. The lubricating oil of claim 2 further comprising about 0.5% of molybdenum dialklycarbamate.

4. The lubricating oil of claim 1 further comprising about 1.0% of a 35-di-t-butyl hydroxyl hydrocinnamic acid alkyl ester.

5. The lubricating oil of claim 4 further comprising about 0.5% of molybdenum dialkylcarbamate, 1.0% of zinc diamyldithiocarbamate, and 1.0% of antimony dialkyldithiocarbamate.

6. The lubricating oil of claim 4 further comprising about 1.0% of methylene bis(dibutyldithiocarbamate); about 1.0% of a bicyclo[3.1.1]Hept-2-ene-2,6,6-trimethyl-phosphosulfurized antiwear/antioxidant additive; and about 1.0% of 3[[bis(1-methylethoxy) phosphinothioyl]thio] propanic acid, ethyl ester.

7. The lubricating oil of claim 6 further comprising about 0.5% of molybdenum dialkylcarbamate.

8. A concentrated additive for a lubricating oil comprising:

a. about 50% of a paraffinic base oil;
b. about 1 to about 3% of a magnesium salt of alkylated aryl sulfonic acid or calcium salt of benzene sulfonic acid
c. about 0.005% of a compounded silicone fluid;
d. about 0.5 to 1.5% of 1H-Benzotriazole-1-methanamine-N,N-bis(2-ethyl hexyl)-methyl;
e. about 0.5 to about 1.5% of a 2,5-dimercapto-1,3,4-thiadiazole derivative;
h. about 3.0% of a diethanolamine derivative;
i. about 9 to about 10% of an ethylene-propylene copolymer;
j. about 2% of a dispersant selected from the group selected of a borated polyisobutenyl succinic anhydride, an amine compound with (polybutenyl) succinic anhydride, a polyethylene poly-, compound with (polybutenyl) succinic anhydride and combinations thereof;
k. about 0.3% of a dialkyl fumerate/vinyl acetate copolymer; and
l. about 0.5% of (tetrapropenyl)-butanedioic acid, monoester with 1,2-propanediol and (tetrapropenyl)-butanedioic acid wherein said the concentrated additive is absolutely free of ZDTP.

9. The concentrated additive of claim 8 further comprising about 5% of 3,5-di-tert-butyl-4-hydroxyl hydrocinnamic acid alkyl esters; about 5.0% of methylene bis(dibutyldithiocarbamate) and about 10.0% of a dithiocarbamate derivative.

10. The concentrated additive of claim 9 further comprising about 5.0% of molybdenum dialklycarbamate.

11. The concentrated additive of claim 8 further comprising about 5.0% of a 3,5-di-tert-butyl-4 hydroxyl hydrocinnamic acid alkyl ester.

12. The concentrated additive of claim 11 further comprising about 5.0% of molybdenum dialkylcarbamate; 10.0% of zinc diamyldithiocarbamate; and 7.0% of antimony dialkyldithiocarbamate.

13. The concentrated additive of claim 11 further comprising about 5.0% of methylene bis-(dibutyldithiocarbamate); about 5.0% of a bicyclo[3.1.1]hept-2-ene-2,6,6-trimethylphosphosulfurized antiwear/antioxidant additive; and about 5.0% of 3[[bis(1-methylethoxy) phosphinothioyl]thio] propanic acid, ethyl ester.

14. The concentrated additive of claim 13 further comprising about 5.0% of molybdenum dialkylcarbamate.

* * * * *